US008466941B2

(12) United States Patent
Oshiro et al.

(10) Patent No.: US 8,466,941 B2
(45) Date of Patent: Jun. 18, 2013

(54) SHEET CONVEYING APPARATUS, ERASING APPARATUS, AND IMAGE FORMING APPARATUS

(75) Inventors: Toshiaki Oshiro, Shizuoka-ken (JP); Tetsuhiro Morita, Shizuoka-ken (JP); Hiroyuki Hazu, Shizuoka-ken (JP); Hitoshi Adachi, Shizuoka-ken (JP); Ken Iguchi, Shizuoka-ken (JP); Takahiro Kawaguchi, Shizuoka-ken (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 38 days.

(21) Appl. No.: 13/294,728

(22) Filed: Nov. 11, 2011

(65) Prior Publication Data

US 2012/0188324 A1 Jul. 26, 2012

Related U.S. Application Data

(60) Provisional application No. 61/435,559, filed on Jan. 24, 2011.

(51) Int. Cl.
*B41J 29/16* (2006.01)

(52) U.S. Cl.
USPC ..... 347/179

(58) Field of Classification Search
USPC ..... 347/171, 179, 222; 358/448, 498
See application file for complete search history.

(56) References Cited

U.S. PATENT DOCUMENTS

2009/0097082 A1* 4/2009 Wada ..... 358/498
2010/0315475 A1* 12/2010 Taki et al. ..... 347/179
2011/0085217 A1* 4/2011 Jo ..... 358/498

* cited by examiner

*Primary Examiner* — Kristal Feggins
(74) *Attorney, Agent, or Firm* — Patterson & Sheridan, LLP

(57) ABSTRACT

According to one embodiment, a sheet conveying apparatus includes: a guide section that forms a one side guide surface of a sheet conveying path, the guide section having a first guide member and a second guide member which are continuously arranged from a conveying direction upstream side to a conveying direction downstream side, at least one of the first guide member and the second guide member being a guide member that rotates to open and close; and a joint section that forms an uneven joint with a conveying direction downstream side end of the first guide member and a conveying direction upstream side end of the second guide member, the downstream side end of the first guide member being arranged further on an inner side than the upstream side end of the second guide member with respect to the sheet conveying path if at least one of the first guide member and the second guide member is closed.

20 Claims, 7 Drawing Sheets

SHEET CONVEYING APPARATUS, ERASING APPARATUS, AND IMAGE FORMING APPARATUS

CROSS-REFERENCE TO RELATED APPLICATION

This application is based upon and claims the benefit of priority from: U.S. provisional application 61/435,559, filed on Jan. 24, 2011; the entire contents of which are incorporated herein by reference.

FIELD

Embodiments described herein relate generally to the structure of a sheet guide section, which rotates to open and close, arranged in a sheet conveying path in a sheet conveying apparatus that conveys a sheet such as a printed sheet or a printing sheet for printing.

BACKGROUND

In a sheet conveying apparatus that conveys a sheet such as a printed sheet or a printing sheet for printing, a guide section configured to regulate both surface positions of a sheet to be conveyed is arranged. In the guide section, guide members that form a conveying path space extending along a conveying direction are arranged to be opposed to each other. The guide member on one side can rotate to open and close to make it possible to easily perform maintenance such as removal of a paper jam or cleaning of a sheet conveying path.

If a step is present in a joint section of the opening and closing guide, which rotates to open and close, and the guide member arranged and fixed on a conveying direction downstream side of the opening and closing guide member, a jam could be caused in a sheet being conveyed. Such a jam tends to occur if the leading end of a sheet curls.

If a sheet jamming in such a joint section is removed from the conveying path space, the opening and closing guide member is rotated and opened. When paper jam treatment ends, the opening and closing guide member is returned to the original closed position.

If the opening and closing guide member is maintained in the closed position, high positioning accuracy is required to prevent a step from being formed in the joint section. As a method of positioning and fixing the opening and closing guide member, a positioning and fixing section is proposed in which a magnet is attached to the opening and closing guide member, a magnetic body such as iron to which the magnetic is magnetically attracted is attached to a conveying apparatus body, and the magnet is magnetically attracted to the magnetic body to fix the opening and closing guide member in a predetermined position to be unable to pivot.

However, to prevent a step from being formed in a portion forming the joint section of the opening and closing guide member and the fixed guide member, position adjustment for the magnet and the magnetic body has to be performed for each of products, which is time-consuming work. Therefore, there is a demand for a proposal of a sheet conveying path that makes it unnecessary to provide the positioning and fixing section and can prevent occurrence of a jam in the joint section without requiring positioning and adjustment.

DETAILED DESCRIPTION

A sheet conveying apparatus according to an embodiment includes a guide section that forms a one side guide surface of a sheet conveying path, the guide section having a first guide member and a second guide member which are continuously arranged from a conveying direction upstream side to a conveying direction downstream side, at least one of the first guide member and the second guide member being a guide member that rotates to open and close.

The sheet conveying apparatus includes a joint section in which a joint section that forms an uneven joint with a conveying direction downstream side end of the first guide member and a conveying direction upstream side end of the second guide member, the downstream side end of the first guide member being arranged further on an inner side than the upstream side end of the second guide member with respect to the sheet conveying path if at least one of the first guide member and the second guide member is closed.

The sheet conveying apparatus according to this embodiment is explained in detail below with reference to the drawings.

First Embodiment

Figure 1:
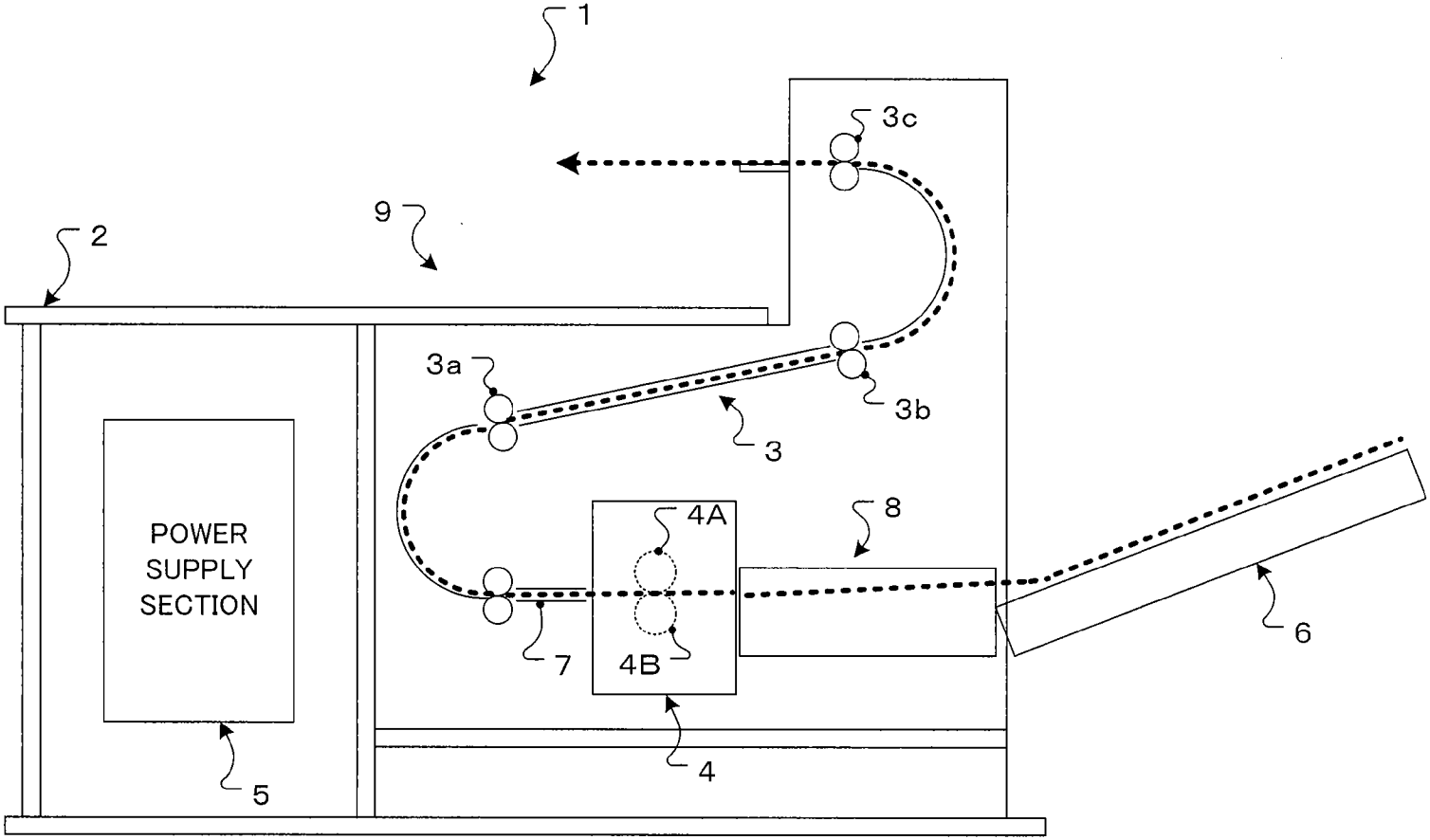
FIG. 1 is a schematic front view of an erasing apparatus according to a first embodiment including a sheet conveying apparatus.
Figure 2:
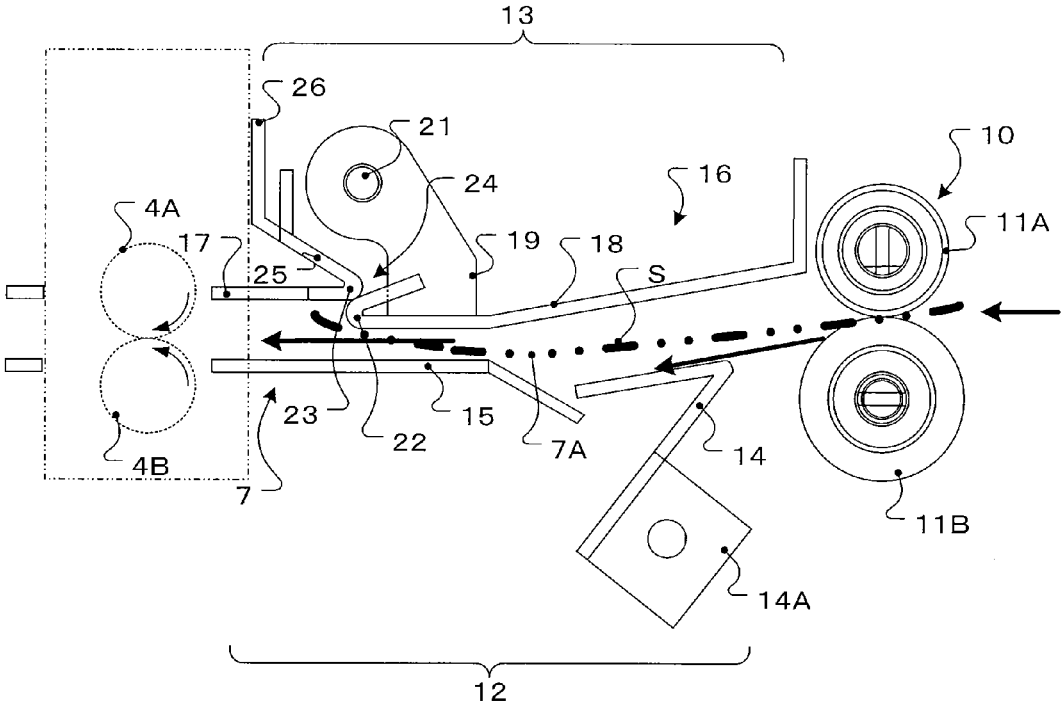
FIG. 2 is a front view of a sheet delivery section in the sheet conveying apparatus shown in FIG. 1, wherein a state in which a rotational opening and closing member is closed is shown.
Figure 3:
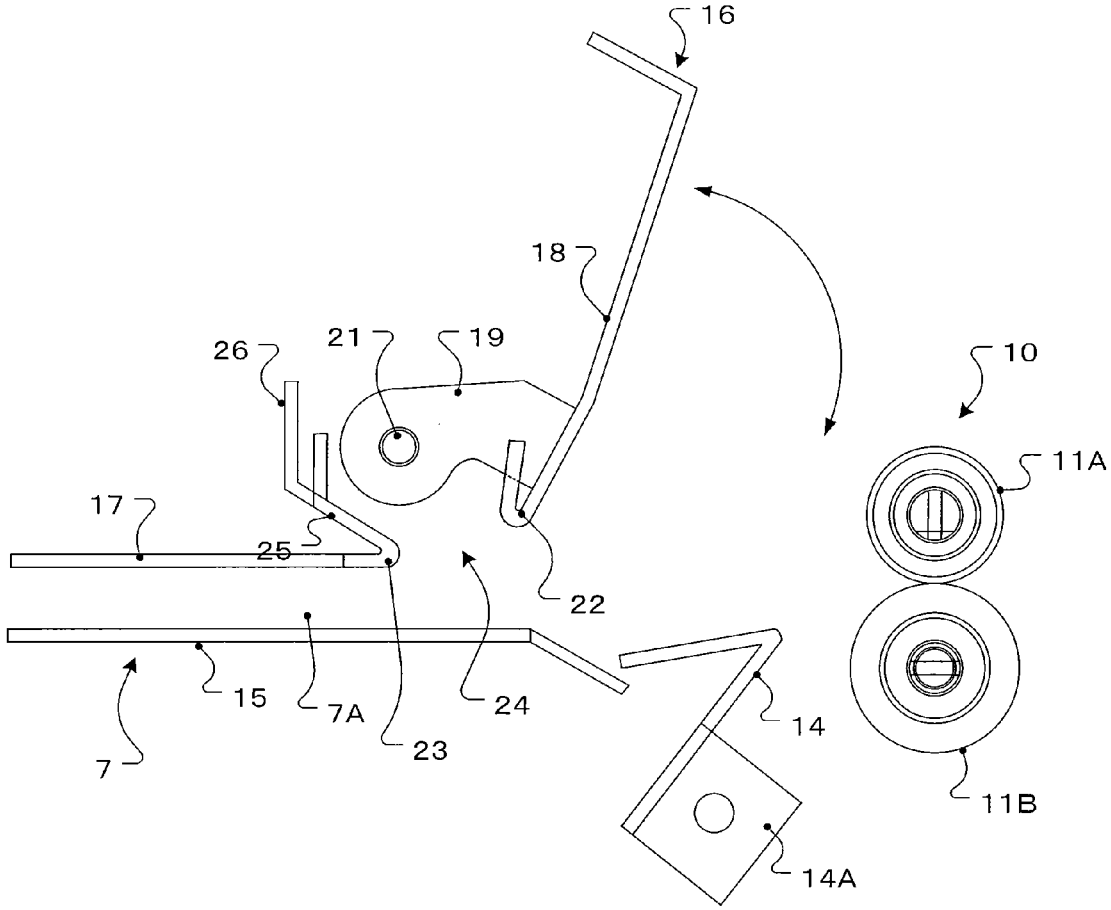
FIG. 3 is a front view of the sheet delivering section in the sheet conveying apparatus shown in FIG. 1, wherein a state in which the rotational opening and closing member is opened is shown.

FIG. 1 is a schematic front view of an erasing apparatus according to a first embodiment including the sheet conveying apparatus. FIGS. 2 and 3 are front views of a sheet delivery section in the sheet conveying apparatus shown in FIG. 1. A state in which an opening and closing guide member of the sheet delivery section is closed is shown in FIG. 2. A state in which the opening and closing member of the sheet delivery section is opened is shown in FIG. 3.

An erasing apparatus 1 is an apparatus for erasing an image formed on a sheet with erasable ink by, for example, an electrophotographic system and reusing the sheet from which the image is erased. The erasable ink has a characteristic that the erasable ink is erased if heated at predetermined temperature.

In the erasing apparatus 1, a power supply section 5 configured to supply electric power to a sheet conveying path 3 having a reverse S shape, a heating section 4, and the like is arranged in an apparatus body 2. On one side of the apparatus body 2, a paper feeding cassette 6 configured to store a sheet on which an image is formed with an erasable color material such as erasable toner or erasable ink is arranged. The sheet stored in the paper feeding cassette 6 is fed to a conveyance upstream end of the sheet conveying path 3.

The heating section 4 is arranged in a lower stage linear conveying section 7 of the sheet conveying path 3. The sheet fed from the paper feeding cassette 6 is conveyed to the heating section 4 through a delivery section 8 of the sheet conveying path 3. In the heating section 4, a nip portion where a heating roller 4A and a pressing roller 4B are in press-contact with each other is formed.

As indicated by a broken line, the sheet conveying path 3 conveys a sheet printed with the erasable color material and stored in the paper feeding cassette 6 from the delivery section 8 to the nip portion of the heating section 4, conveys the erased sheet passed through the nip portion to a discharge roller 3*c* via conveying rollers 3*a* and 3*b*, and discharges the sheet onto a stacking section 9 from the discharge roller 3*c*. When the sheet is discharged, it may be inspected whether an image on the sheet is erased by a scanner.

The configuration of the delivery section 8 is explained with reference to FIGS. 2 to 5.

In the delivery section 8, a first conveyance guide section 12 and a second conveyance guide section 13 are arranged to be vertically opposed to each other between a paper feeding section 10 arranged in the conveyance upstream end of the sheet conveying path 3 and the heating section 4. The delivery section 8 conveys a sheet to between the first conveyance guide section 12 and the second conveyance guide section 13. The paper feeding section 10 includes a pair of paper feeding rollers 11A and 11B. The paper feeding section 10 feeds the sheet stored in the paper feeding cassette 6 to the heating section 4 and delivers the sheet to the nip portion of the heating section 4.

In the first conveyance guide 12 on the lower side, a first lower guide member 14 arranged on a conveying direction upstream side and a second lower guide member 15 arranged on a conveying direction downstream side are continuously arranged along the conveying direction. The first lower guide member 14 is formed as a slope tilting further downward toward the downstream side in the conveying direction, whereby the conveyed sheet is conveyed along the surface of the first conveyance guide section 12. A conveying direction upstream end of the second lower guide member 15 is formed as a slope tilting further upward toward the conveying direction downstream side. The conveying direction upstream end of the second lower guide member 15 extends further to a lower position than a conveying direction downstream end of the first lower guide member 14. Therefore, the sheet passed through the conveying direction downstream end of the first lower conveyance guide member 14 is conveyed while being guided by the conveying direction upstream end of the second lower guide member 15 to change the direction upward and is guided to the nip portion of the heating section 4.

Figure 4:
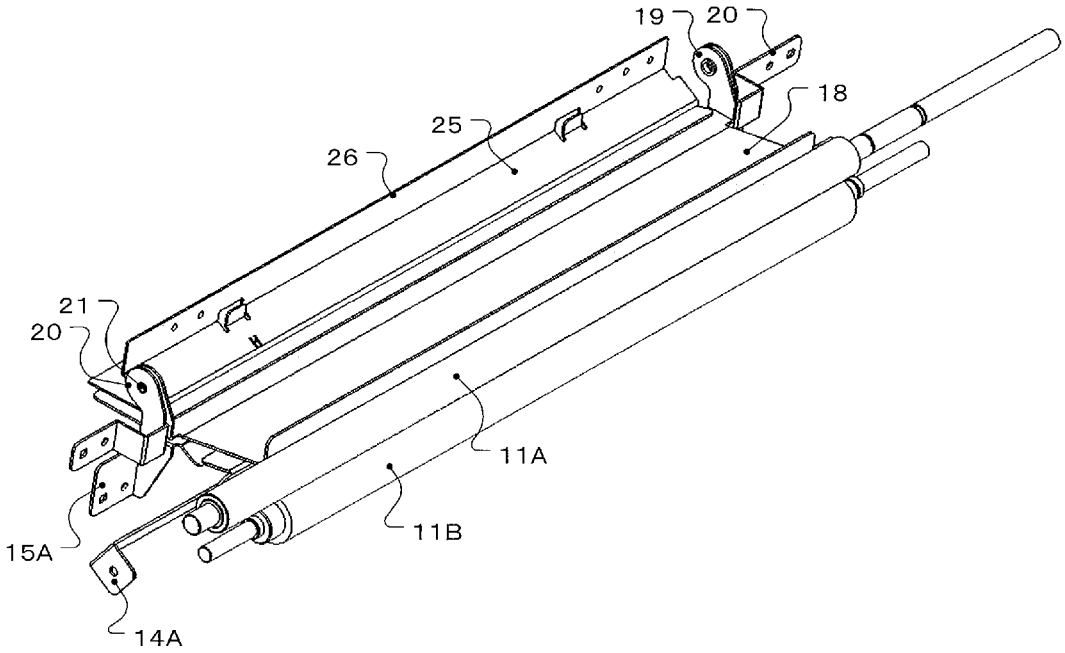
FIG. 4 is a perspective view of the sheet delivering section shown in FIG. 2 viewed from an upstream side to a downstream side in a sheet conveying direction.
Figure 5:
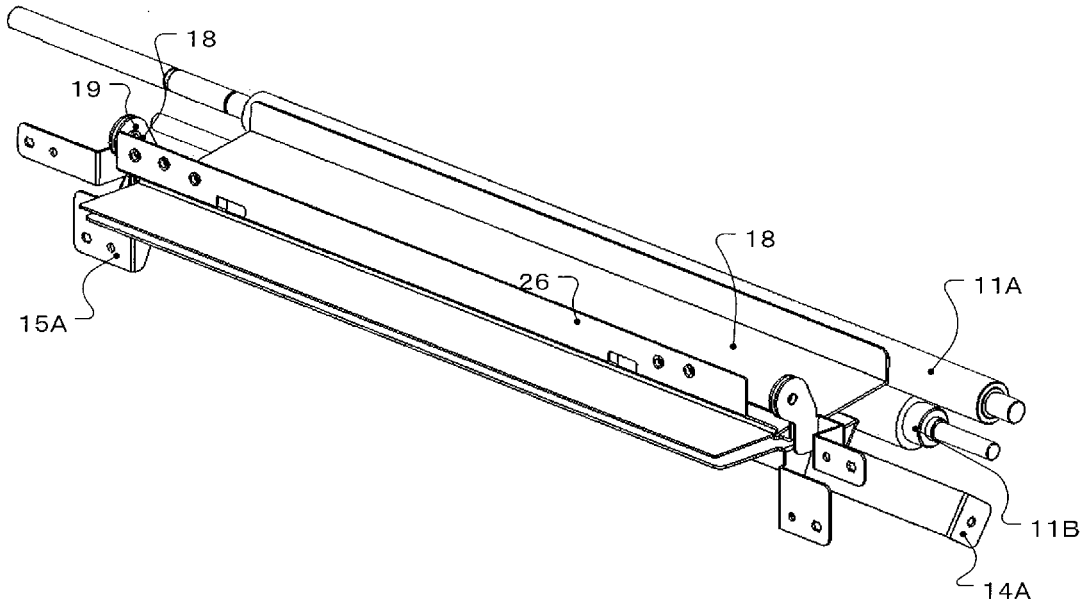
FIG. 5 is a perspective view of the sheet delivering section shown in FIG. 2 viewed from the downstream side to the upstream side in the sheet conveying direction.

The second conveyance guide section 13 on the upper side includes an opening and closing guide member 16 arranged on a conveyance upstream side and an upper guide member 17 arranged on a conveyance downstream side. The opening and closing guide member 16 includes a flat-shaped guide body section 18 extending along a width direction orthogonal to the sheet conveying direction. At both width direction ends of the guide body section 18, supporting arms 19 are respectively provided at a conveying direction downstream end of the guide body section 18. As shown in FIGS. 4 and 5, the supporting arms 19 are rotatably attached to attachment brackets 20, which are fixed to, for example, the heating section 4, via supporting shafts 21. A conveying direction downstream end 22 of the guide body section 18 is folded back upward to increase rigidity. The conveying direction downstream end 22 is formed as a stopper section configured to regulate a closing position of the opening and closing guide member 16.

The upper guide member 17 is formed in a flat shape extending along the width direction orthogonal to the sheet conveying direction. A conveying direction upstream end 23 of the upper guide member 17 is formed as a stopper section folded back upward to increase rigidity. In a state in which the opening and closing guide member 16 rotates to a predetermined closing position, the conveying direction upstream end 23 of the upper guide member 17 is arranged further on the outer side (above) than the conveying direction downstream end 22 of the opening and closing guide member 16. The conveying direction downstream end 22 of the opening and closing guide member 16 comes into contact with the conveying direction upstream end 23 of the upper guide member 17 to position the opening and closing guide member 16 in the predetermined closing position.

In this embodiment, the conveying direction downstream end 22 of the opening and closing guide member 16 and the conveying direction upstream end 23 of the upper guide member 17 form a joint section 24 of the opening and closing guide member 16 and the upper guide member 17 continuously arranged from the conveyance direction upstream side to the conveying direction downstream side.

In this embodiment, the joint section 24 is formed in an uneven structure in which, in a state in which the opening and closing guide member 16 is positioned in the predetermined closing position, the conveying direction downstream end 22 of the opening and closing guide member 16 is arranged on the inner side and the conveying direction upstream end 23 of the upper guide member 17 is arranged on the outer side viewed from a sheet conveyed in a conveying path space 7A.

In other words, in the uneven structure of the joint section 24, as shown in FIG. 2, when a sheet S is conveyed while being guided by the opening and closing guide member 16, a portion with which the leading end of the sheet S engages is not present in a direction opposed to the leading end of the sheet S.

Therefore, as shown in FIG. 2, if the leading end of the sheet S fed by the pair of paper feeding rollers 11A and 11B curls, a portion where the leading end of the sheet S is caught is not present in the joint section 24. Therefore, the leading end of the sheet S moves to the nip portion of the heating roller 4A and the pressing roller 4B of the heating section 4 while being guided by a guide surface of the upper guide member 17. The sheet S is subjected to erasing processing by the heating section 4 without jamming.

In this embodiment, as the uneven structure in the joint section 24, the conveying direction downstream end 22 of the opening and closing guide member 16 is arranged on the inner side and the conveying direction upstream end 23 of the upper guide member 17 is arranged on the outer side. However, this arrangement relation is not maintained over an entire area in the conveying direction of a guide surface of the opening and closing guide member 16 and the guide surface of the upper guide member 17 excluding the joint section 24. For example, as shown in FIG. 2, the guide body section 18 of the opening and closing guide member 16 may be tilted upward toward the conveying direction upstream side. The upper guide member 17 may be tilted to the inner side toward the conveying direction downstream side.

In the joint section 24, in a state in which the opening and closing guide member 16 is positioned in the predetermined closing position, the conveying direction downstream end 22 of the opening and closing guide member 16 and the conveying direction upstream end 23 of the upper guide member 17 may be arranged to overlap in the conveying direction.

Figure 6A:
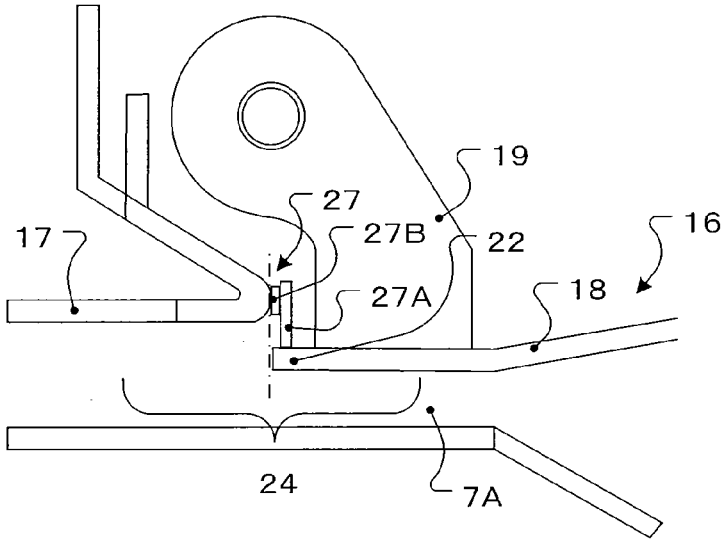
FIGS. 6A and 6B are diagrams respectively of other configurations of a stopper section.
Figure 6B:
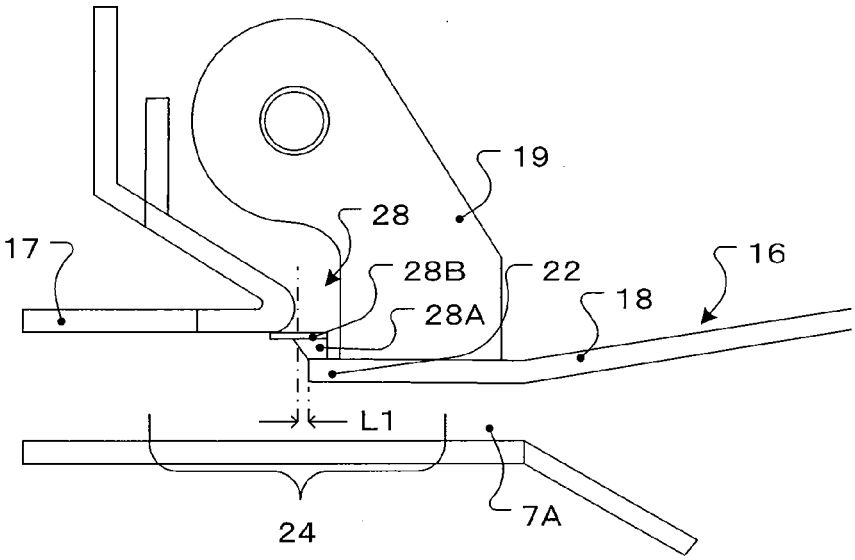

The joint section 24 is not limited to this overlap structure. As shown in FIG. 6A, an end face of the conveying direction downstream end 22 of the opening and closing guide member 16 and an end face of the conveying direction upstream end 23 of the upper guide member 17 may be set in the same position in the conveying direction. As shown in FIG. 6B, the end face of the conveying direction downstream end 22 of the opening and closing guide member 16 and the end face of the conveying direction upstream end 23 of the upper guide member 17 may have a gap L1 between the end faces.

In FIGS. 6A and 6B, stopper sections 27 and 28 are provided downstream in the conveying direction of the guide body section 18 separately from the guide body section 18.

In the stopper section 27 shown in FIG. 6A, a flat plate material 27A extending along the width direction is fixed to a conveying direction downstream section of the guide body section 18. A contact member 27B formed of an elastic member such as rubber, which comes into contact with the end face of the conveying direction upstream end 23 of the upper guide member 17, is fixed to the distal end of the plate material 27A by an adhesive or the like.

In the stopper section 28 shown in FIG. 6B, a supporting member 28A extending along the width direction is fixed to a conveying direction downstream section of the guide body section 18. A contact member 28B, which comes into contact with the guide surface of the upper guide member 17, is fixed to the distal end of the supporting member 28A. The contact member 28B extends from the end face of the guide body section 18 to the conveying direction downstream side.

In this way, the stopper section provided in the opening and closing guide member 16 comes into contact with the upper guide member 17 over the entire surface in the width direction and positions the opening and closing guide member 16 in the predetermined closing position. A plurality of the stopper sections provided in the opening and closing guide member 16 may be formed at an appropriate interval in the width direction and partially come into contact with the upper guide member 17 in plural places.

A distal end 26 of a folded-back section 25 of the upper guide member 17 is fixed to a side of the heating section 4. In the second lower guide member 15, as shown in FIGS. 4 and 5, attachment brackets 15A formed at both ends in the width direction are fixed to the heating section 4. In the first lower guide member 14, as shown in FIGS. 2, 4, and 5, an attachment bracket 14A formed at both ends in the width direction are fixed to the apparatus body.

When a jam occurs in the delivery section 8, to remove a sheet that causes the jam, simply by lifting a conveyance start end side of the guide body section 18 of the opening and closing guide member 16 upward, the opening and closing guide member 16 rotates with the supporting shafts 21 as a fulcrum and a conveyance surface of the first conveyance guide section 12 appears. After the sheet that causes the jam is removed, if a user releases a hand from the opening and closing guide member 16, the opening and closing guide member 16 rotates in a closing direction until the stopper section comes into contact with the upper guide member 17. The opening and closing guide member 16 is positioned in the predetermined closing position.

In the erasing apparatus 1 according to this embodiment, a sheet stored in the paper feeding cassette 6 is not unused but is already printed and actually used. Therefore, since the sheet curls or an end of the sheet is folded, a jam tends to occur. However, the joint section 24 in the second conveyance guide section 13 on the upper side is formed in the uneven structure without a portion with which the leading end of the sheet S conveyed to the conveying direction downstream side engages. Therefore, it is possible to reduce occurrence of a jam. Since the joint section 24 is formed in the uneven structure, high positioning accuracy is unnecessary concerning the predetermined closing position of the opening and closing guide member 16. Therefore, if the opening and closing guide member 16 rotates to the predetermined closing position, ends of the opening and closing guide member 16 and the upper guide member 17 included in the joint section 24 are butted against each other and maintain a contact state each other. Therefore, it is possible to regulate the rotation of the opening and closing guide member 16 and position the opening and closing guide member 16 in the predetermined closing position.

The configuration of the joint section 24 in this embodiment is not applied to the erasing apparatus 1 alone and can be applied to a sheet conveying apparatus that conveys a sheet. The sheet to be conveyed can be applied irrespective of whether the sheet is printed. The sheet is not limited to paper but may be a film-like sheet.

Second Embodiment

Figure 7:
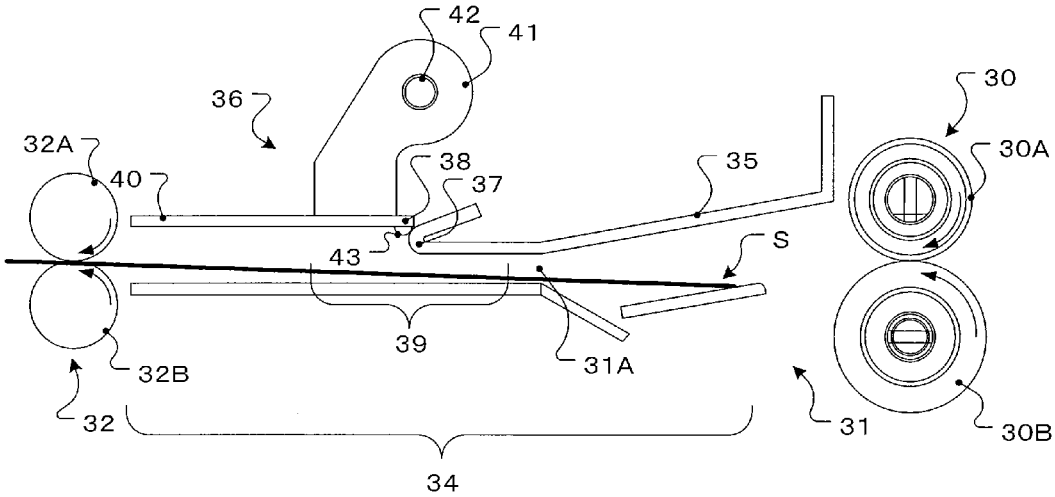
FIG. 7 is a front view of an opening and closing guide member according to a second embodiment, wherein a state in which the opening and closing guide member is closed is shown.
Figure 8:
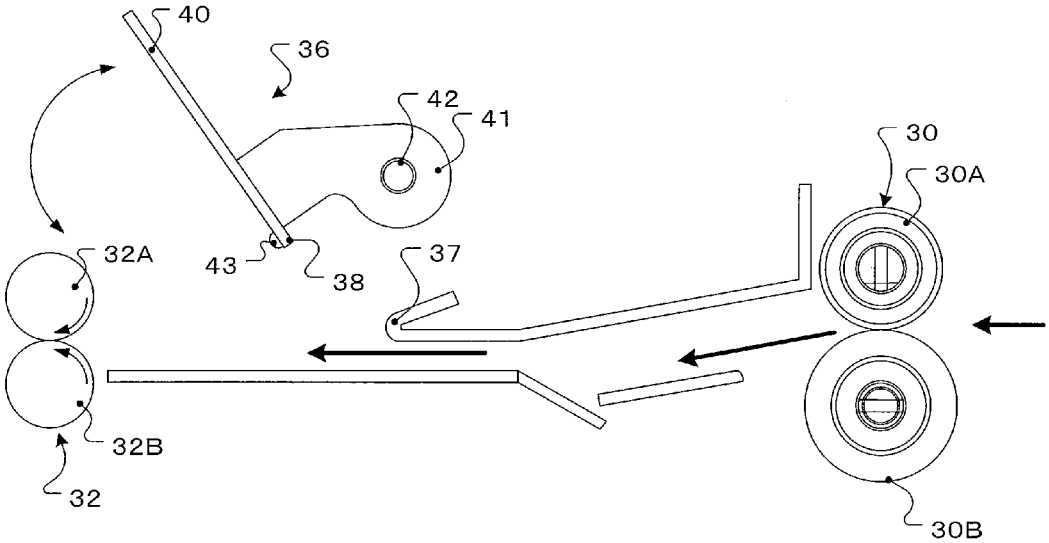
FIG. 8 is a diagram of a state in which the opening and closing guide member shown in FIG. 7 is opened.

A second embodiment is shown in FIGS. 7 and 8.

A sheet conveying apparatus according to this embodiment is configured to convey, with a first conveying section 30 arranged on a conveying direction upstream side, the sheet S to a sheet conveying path 31 and delivers the sheet S to a second conveying section 32 arranged on a conveying direction downstream side. The first conveying section 30 includes a pair of conveying rollers 30A and 30B. The second conveying section 32 includes a pair of conveying rollers 32A and 32B.

In the sheet conveying path 31, an upper first conveyance guide section 33 and a lower second conveyance guide section 34 configured to guide the front and rear surfaces of the sheet S are arranged to be opposed to each other. A conveying path space 31A is formed between the first conveyance guide section 33 and the second conveyance guide section 34. In the first conveyance guide section 33, an upstream side guide member 35 arranged on the conveying direction upstream side and an opening and closing guide member 36 arranged on the conveying direction downstream side are continuously arranged. The upstream side guide member 35 is fixed to an apparatus body and rotates to open and close the opening and closing guide member 36. A downstream side end 37 of the upstream side guide member 35 and an upstream side end 38 of the opening and closing guide member 36 form a joint section 39 having an uneven structure in which the downstream side end 37 of the upstream side guide member 35 is arranged further on the inner side than the upstream side end 38 of the opening and closing guide member 36 with respect to the conveying path space 31A.

In the opening and closing guide member 36, which rotates to open and close, a supporting arm 41 is attached to the conveying direction upstream side end 38 of a tabular guide body section 40 extending in the width direction. The supporting arm 41 is rotatably attached to, via a supporting shaft 42, an attachment bracket (not shown) fixed to the apparatus body. The conveying direction upstream side end 38 of the guide body section 40 forms a stopper section configured to come into contact with the downstream side end 37 of the upstream side guide member 35 and position the opening and closing guide member 36 in a predetermined closing position. For the stopper section to surely come into contact with the downstream side end 37 of the upstream side guide member 35, as shown in FIG. 2, the stopper section may be formed in a structure in which an end of the stopper section is folded back or a structure in which a groove having a U shape or the like is formed at the end along the width direction. Alternatively, a contact member 43 may be fixed to the stopper section.

On the other hand, as a contact section with which the stopper section of the opening and closing guide member 36, which rotates to open and close, comes into contact, the downstream side end 37 of the upstream side guide member 35 is used. As a contact section of the upstream side guide member 35, for example, as shown in FIG. 7, a structure in which an end of the upstream side guide member 35 is folded back and the stopper section comes into contact with the folded-back end along the width direction can be adopted.

In the joint section 39 in this embodiment, as in the joint section 24 shown in FIGS. 6A and 6B, it is also possible to set the stopper section and the end forming the contact section, which comes into contact with the stopper section, in the same position or separate the stopper section and the end without causing the stopper section and the end to overlap.

The joint section 39 is formed in the uneven structure in which the downstream side end 37 of the upstream side guide member 35 is arranged further on the inner side than the upstream side end 38 of the opening and closing guide member 36 viewed from the conveying path space 31A. However, concerning the conveying path space 31A, this uneven arrangement relation does not have to be maintained over an entire length in the conveying direction.

Third Embodiment

Figure 9A:
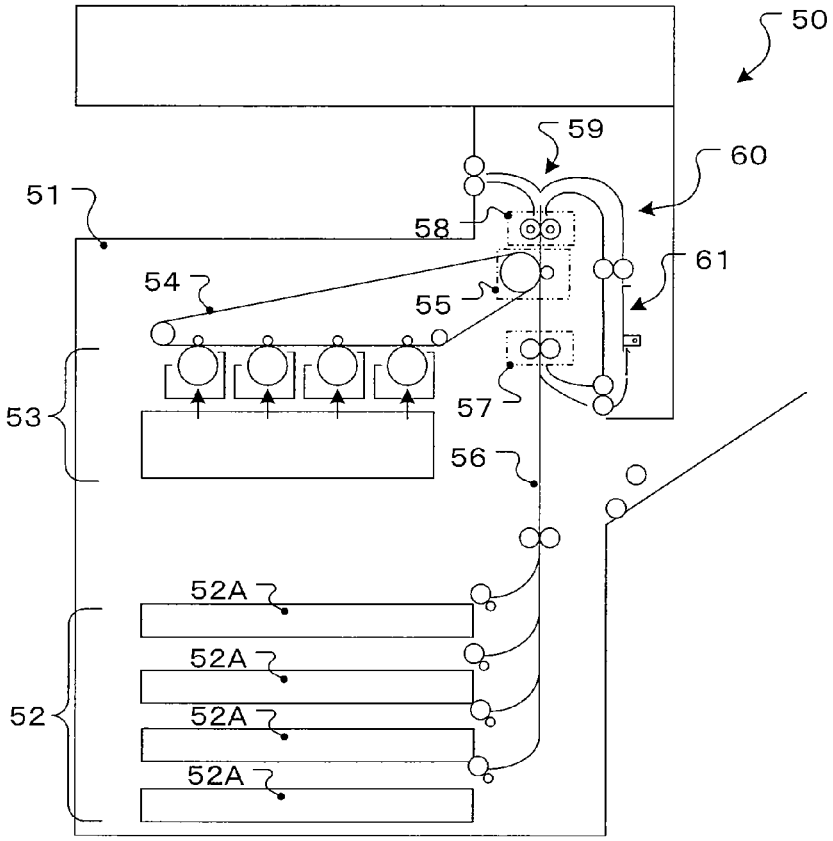
FIG. 9A is a front view of an image forming apparatus according to a third embodiment.
Figure 9B:
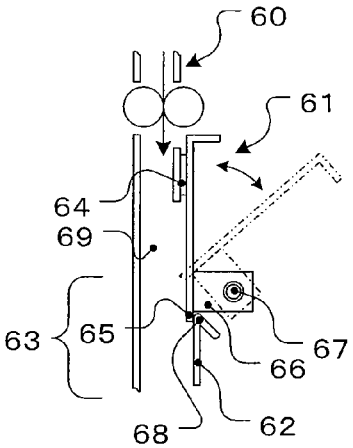
FIG. 9B is a diagram of an opening and closing guide member shown in FIG. 9A.
Figure 9C:
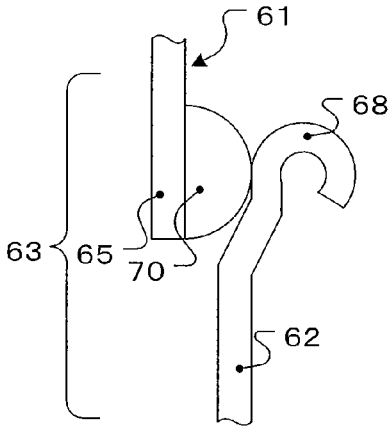
FIG. 9C is a diagram of another configuration of a joint section.

FIG. 9A is a schematic front view of an image forming apparatus according to a third embodiment. FIG. 9B is an enlarged diagram of an opening and closing guide member. FIG. 9C is a diagram of another configuration of a joint section.

An image forming apparatus 50 including a duplex printing function (ADU: Auto Duplex Unit) shown in FIG. 9A includes, in an image forming apparatus body 51, a paper feeding cassette section 52 in which plural paper feeding cassettes 52A are vertically arranged, an image-forming process section 53 configured to form toner images of Y (yellow), M (magenta), C (cyan), and K (black), an endlessly-turning image bearing belt 54 configured to primarily transfer the toner images formed by the image-forming process section 53, and a transfer section 55 configured to transfer the unfixed toner images born on the image bearing belt 54 onto a sheet. The image forming apparatus 50 includes a sheet conveying path 56 configured to convey a sheet for printing to the transfer section 55. The sheet conveying path 56 conveys a sheet input on standby in a registration roller 57 to the transfer section 55 to be timed to coincide with transfer timing. If the sheet passes through the transfer section 55 and the unfixed toner images are transferred onto the sheet, the sheet is conveyed with the unfixed toner images fixed thereon by the fixing section 58. If duplex printing is performed, the sheet is guided to a reversal conveying path 60, in which a conveying path is formed in an up down direction, through a switchback conveying path 59.

In this embodiment, in the reversal conveying path 60, an opening and closing guide member 61 that rotates to open and close is arranged in one of continuous guide members.

A joint section 63 of the opening and closing guide member 61, which rotates to open and close, and a fixed guide member 62 arranged on a conveying direction downstream side adjacent to the opening and closing guide member 61 is formed in an uneven structure as in the embodiments explained above. The fixed guide member 62 is fixed to an apparatus body.

Since a predetermined closing position of the opening and closing guide member 61 in this embodiment is in the vertical direction, unlike the embodiments explained above, the opening and closing guide member 61 cannot be held in the predetermined closing position with the own weight of the opening and closing guide member 61. Therefore, the opening and closing guide member 61 is held in the predetermined closing position using a lock member 64.

In the opening and closing guide member 61, a supporting arm 66 is arranged at a lower end 65 on the conveying direction downstream side. The supporting arm 66 is rotatably supported on the apparatus body via a supporting shaft 67.

The lower end 65 of the opening and closing guide member 61 is formed as a flat surface and an upper end 68 of the fixed guide member 62 is formed in a folded-back shape to increase rigidity. In a state in which the opening and closing guide member 61 rotates to the predetermined closing position, the lower end 65 of the opening and closing guide member 61 and the upper end 68 of the fixed guide member 62 overlap. The lower end 65 of the opening and closing guide member 61 is located further on the inner side than the upper end 68 of the fixed guide member 62 with respect to a conveying path space 69 and comes into contact with the upper end 68.

The upper end 68 of the fixed guide member 62 may be formed in a flat surface shape. As shown in FIG. 9C, a semi-columnar contact section 70 may be attached to the lower end 65 of the opening and closing guide member 61 along the width direction and the upper end 68 of the fixed guide member 62 may be formed in a half tube shape.

In this embodiment, in a step of the joint section 63, when viewed in the conveying path space 69, the upper end 68 of the fixed guide member 62 on the conveying direction downstream side is located further on the outer side than the lower end 65 of the opening and closing guide member 61 on a conveying direction upstream side. In other words, in the joint section 63, a portion where the leading end of a sheet is caught is not present on the conveying direction downstream side from the lower end of the opening and closing guide member 61. Therefore, if the leading end of the sheet is moving while coming into contact with a guide surface in the joint section 63, the leading end of the sheet smoothly passes through the joint section 63. Therefore, it is possible to prevent a paper jam from occurring in the joint section 63.

In this embodiment, since a sheet printed on one side tends to curl, a paper jam tends to occur in the reversal conveying path 60. However, even if the leading end of the curled sheet moves while coming into contact with the guide surface of the joint section 63, an uneven structure expanding to the outer side of the conveying path space 69 is formed on the conveying direction downstream side from the lower end 65 of the opening and closing guide member 61. Therefore, when the leading end of the sheet passes the lower end 65 of the opening and closing guide member 61, the leading end of the curled sheet moves onto the guide surface of the upper end 68 of the fixed guide member 62. In that state, the sheet is conveyed to the conveying downstream side.

The structures of the joint sections in the embodiments are examples only. A joint section of guide members continuously arranged along the conveying direction only has to be formed in an uneven structure in which a conveyance upstream side end of the guide member on the downstream side is located further on the outer side than a conveyance downstream side end of the guide member on the upstream side viewed from the conveying path space and is partially expanded. The guide member, which rotates to open and close, may be either the guide member on the upstream side or the guide member on the downstream side.

Further, the structures in the embodiments in which, in order to regulate the guide member, which rotates to open and close, from rotating beyond the predetermined closing position, the end of the other guide member is used are examples only. The structures of the ends forming the joint section of the continuous guide members may be any structures as long as the uneven structure can be maintained.

The present invention can be carried out in other various forms without departing from the spirit and the main characteristics of the present invention. Therefore, the embodiments are merely examples in every aspect and should not be limitedly interpreted. The scope of the present invention is indicated by the scope of the claims and is not limited by the text of the specification at all. Further, all modifications and various improvement, substitutions, and alterations belonging to the scope of equivalents of the scope of the claims are within the scope of the present invention.

What is claimed is:

1. A sheet conveying apparatus comprising:

a guide section that forms a one side guide surface of a sheet conveying path, the guide section having a first guide member and a second guide member which are continuously arranged from a conveying direction upstream side to a conveying direction downstream side, at least one of the first guide member and the second guide member being a guide member that rotates to open and close; and a joint section that forms an uneven joint with a conveying direction downstream side end of the first guide member and a conveying direction upstream side end of the second guide member, the downstream side end of the first guide member being arranged further on an inner side than the upstream side end of the second guide member with respect to the sheet conveying path if at least one of the first guide member and the second guide member is closed.

2. The apparatus according to claim 1, wherein, in the joint section, a stopper section is provided in which an end of the one guide member, which rotates to open and close, comes into contact with an end of the other guide member and regulates the one guide member, which rotates to open and close, to rotate to a closing position.

3. The apparatus according to claim 1, wherein, in the joint section, the conveying direction downstream side end of the first guide member and the conveying direction upstream side end of the second guide member are arranged anywhere between a position where the downstream side end and the upstream side end overlap each other and a position where the downstream side end and the upstream side end do not overlap each other in the conveying direction.

4. The apparatus according to claim 1, wherein, in an uneven portion of the joint section formed by the conveying direction downstream side end of the first guide member and the conveying direction upstream side end of the second guide member, a stopper section is provided in which an end of the one guide member, which rotates to open and close, comes into contact with an end of the other guide member and regulates the one guide member, which rotates to open and close, to rotate to a closing position.

5. The apparatus according to claim 2, wherein, in the stopper section, the ends of the first guide member and the second guide member continuously come into contact with each other along a sheet width direction orthogonal to a sheet conveying direction.

6. The apparatus according to claim 2, wherein, in the stopper section, the ends of the first guide member and the second guide member partially come into contact with each other in plural places along a sheet width direction orthogonal to a sheet conveying direction.

7. The apparatus according to claim 2, wherein, in the stopper section, both or any one of ends of the first guide member and the second guide member is formed in a high rigidity shape.

8. The apparatus according to claim 2, wherein the stopper section is provided at the end of the one guide member, which rotates to open and close.

9. An erasing apparatus comprising:

a sheet conveying path;

a paper feeding section arranged on a conveying direction upstream side of the sheet conveying path and configured to feed a printing sheet printed with an erasable color material to a downstream side of the sheet conveying path;

a heating section arranged on a conveying direction downstream side of the sheet conveying path and configured to heat the printing sheet fed to the sheet conveying path and subject the printing sheet to erasing;

a guide section that forms a one side guide surface of a sheet conveying path, the guide section having a first guide member and a second guide member which are continuously arranged from a conveying direction upstream side to a conveying direction downstream side, at least one of the first guide member and the second guide member being a guide member that rotates to open and close; and a joint section that forms an uneven joint with a conveying direction downstream side end of the first guide member and a conveying direction upstream side end of the second guide member, the downstream side end of the first guide member being arranged further on an inner side than the upstream side end of the second guide member with respect to the sheet conveying path if at least one of the first guide member and the second guide member is closed.

10. The apparatus according to claim 9, wherein, in the joint section, a stopper section is provided in which an end of the one guide member, which rotates to open and close, comes into contact with an end of the other guide member and regulates the one guide member, which rotates to open and close, to rotate to a closing position.

11. The apparatus according to claim 9, wherein, in the joint section, the conveying direction downstream side end of the first guide member and the conveying direction upstream side end of the second guide member are arranged anywhere between a position where the downstream side end and the upstream side end overlap each other and a position where the downstream side end and the upstream side end do not overlap each other in the conveying direction.

12. The apparatus according to claim 9, wherein, in an uneven portion of the joint section formed by the conveying direction downstream side end of the first guide member and the conveying direction upstream side end of the second guide member, a stopper section is provided in which an end of the one guide member, which rotates to open and close, comes into contact with an end of the other guide member and regulates the one guide member, which rotates to open and close, to rotate to a closing position.

13. The apparatus according to claim 10, wherein, in the stopper section, the ends of the first guide member and the second guide member continuously come into contact with each other along a sheet width direction orthogonal to a sheet conveying direction.

14. The apparatus according to claim 10, wherein, in the stopper section, the ends of the first guide member and the second guide member partially come into contact with each other in plural places along a sheet width direction orthogonal to a sheet conveying direction.

15. The apparatus according to claim 10, wherein, in the stopper section, both or any one of ends of the first guide member and the second guide member is formed in a high rigidity shape.

16. The apparatus according to claim 10, wherein the stopper section is provided at the end of the one guide member, which rotates to open and close.

17. An image forming apparatus comprising:

a sheet conveying path configured to convey a printing sheet to a printing section;

a guide section that forms a one side guide surface of a sheet conveying path, the guide section having a first guide member and a second guide member which are continuously arranged from a conveying direction upstream side to a conveying direction downstream side, at least one of the first guide member and the second guide member being a guide member that rotates to open and close; and a joint section that forms an uneven joint with a conveying direction downstream side end of the first guide member and a conveying direction upstream side end of the second guide member, the downstream side end of the first guide member being arranged further on an inner side than the upstream side end of the second guide member with respect to the sheet conveying path if at least one of the first guide member and the second guide member is closed.

18. The apparatus according to claim 17, wherein, in the joint section, a stopper section is provided in which an end of the one guide member, which rotates to open and close, comes into contact with an end of the other guide member and regulates the one guide member, which rotates to open and close, to rotate to a closing position.

19. The apparatus according to claim 17, wherein, in the joint section, the conveying direction downstream side end of the first guide member and the conveying direction upstream side end of the second guide member are arranged anywhere between a position where the downstream side end and the upstream side end overlap each other and a position where the downstream side end and the upstream side end do not overlap each other in the conveying direction.

20. The apparatus according to claim 17, wherein, in an uneven portion of the joint section formed by the conveying direction downstream side end of the first guide member and the conveying direction upstream side end of the second guide member, a stopper section is provided in which an end of the one guide member, which rotates to open and close, comes into contact with an end of the other guide member and regulates the one guide member, which rotates to open and close, to rotate to a closing position.

* * * * *